US007285026B1

(12) United States Patent
Ju

(10) Patent No.: US 7,285,026 B1
(45) Date of Patent: Oct. 23, 2007

(54) COMPRESSED CONTACT ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/580,979

(22) Filed: Oct. 16, 2006

(51) Int. Cl.
*H01R 13/24* (2006.01)

(52) U.S. Cl. ..... 439/700; 439/824

(58) Field of Classification Search ..... 439/700, 439/66, 824
See application file for complete search history.

(56) References Cited

U.S. PATENT DOCUMENTS

| | | | | |
|---|---|---|---|---|
| 4,385,754 | A * | 5/1983 | Waite | 267/71 |
| 5,362,241 | A * | 11/1994 | Matsuoka et al. | 439/66 |
| 6,241,560 | B1 * | 6/2001 | Furusawa et al. | 439/700 |
| 6,663,439 | B2 * | 12/2003 | Henry et al. | 439/700 |
| 6,716,043 | B2 * | 4/2004 | Ishizuka | 439/131 |
| 7,097,485 | B1 * | 8/2006 | Wang et al. | 439/289 |
| 2004/0053539 | A1 * | 3/2004 | Watanabe | 439/700 |
| 2005/0064738 | A1 * | 3/2005 | Zheng et al. | 439/65 |

FOREIGN PATENT DOCUMENTS

| | | |
|---|---|---|
| CN | 217081.7 | 8/2001 |
| CN | 2254746.0 | 9/2003 |
| CN | 2293473.1 | 12/2003 |

* cited by examiner

*Primary Examiner*—Tulsidas C. Patel
*Assistant Examiner*—Vladimir Imas
(74) *Attorney, Agent, or Firm*—Rosenberg, Klein & Lee

(57) ABSTRACT

An electrical connector is used for connecting two electronic elements. The electrical connector includes an insulating body and conducting pins. There are a plurality of pin-receiving holes on the insulating body. Each of the conducting pins has a first conducting pin and a second conducting pin that moves relatively, and a flexible body is located between the first conducting pin and the second conducting pin for pushing the first conducting pin and the second conducting pin to move relatively. At least one conducting pin flexibly contacts and is connected with the corresponding electronic element. The two conducting pins contact each other to conduct the two electronic elements. The two conducting pins are flake-shaped. Thereby, the electrical connector is electrically connected with the electronic element well.

34 Claims, 5 Drawing Sheets

COMPRESSED CONTACT ELECTRICAL CONNECTOR

BACKGROUND OF THE INVENTION

1. Field of the Invention

The present invention relates to an electrical connector. In particular, this invention relates to a compressed-contacted electrical connector.

2. Description of the Related Art

The compressed-contacted electrical connector of the prior art usually includes an insulating body and conducting pins received in the insulating body. The insulating body has pin-receiving slots and the conducting pins are received in the pin-receiving slots. China patent CN 00217081 discloses a two ended compressed-contacted electrical connector. The conducting pin includes a fixing part and contacting parts located at two ends of the conducting pins. China patent CN 02254746 discloses an electrical connector in which one end of the conducting pin is a compressed-contacted type and the other end of the conducting pin is a welded type. The conducting pin includes a holding part, a contacting part located at one end of the holding part, and a welding part located at another end of the holding part. However, both of the conducting pins have a single structure. The conducting pin is formed by punching and bending a metallic material. When the contacting part of the conducting pin is pressed or bumped, the contacting part of the conducting pin deforms easily. Therefore, the contacting part of the conducting pin cannot recover to its original shape, and it loses its flexibility so that the electrical connector cannot contact the electronic element well and the electrical connector becomes abnormal. Furthermore, in order to make the conducting pin have enough flexible force, a copper alloy is selected. For example, phosphorous copper has a low cost. However, its electric conductivity is too low and is only around 20% ISCA. Special copper has an acceptable cost. However, its electric conductivity is still low being between 40-60% ISCA. Although the electric conductivity of beryllium copper is 80% ISCA, it is too expensive. Red bronze has better electric conductivity. However, the mechanical characteristics are unacceptable.

China patent CN 02293473 discloses an electrical connector that overcomes some drawbacks of the above electrical connector. The electrical connector includes a metal covering shell and a probe. There is a spring between the metal covering shell and the probe that increases the flexibility of the electrical connector. When a force is exerted to the spring, the spring easily swings horizontally so as to bump the metal covering shell. Therefore, the metal covering shell and the probe also swing horizontally. The stability of the electrical connector is thereby affected.

SUMMARY OF THE INVENTION

One particular aspect of the present invention is to provide an electrical connector that contacts the electronic element well.

The electrical connector is used for connecting two electronic elements. The electrical connector includes an insulating body and conducting pins. There are a plurality of pin-receiving holes on the insulating body. Each of the conducting pins has a first conducting pin and a second conducting pin that moves relatively, and a flexible body located between the first conducting pin and the second conducting pin for pushing the first conducting pin and the second conducting pin to move relatively. At least one conducting pin flexibly contacts and is connected with the corresponding electronic element. The two conducting pins contact each other to conduct the two electronic elements. The two conducting pins are flake-shaped.

There are two conducting pins in each of the pin-receiving holes of the electrical connector, and a flexible body is located between the two conducting pins. When an external force is exerted on the electrical connector, one of the conducting pins can move upwards and downwards in the insulating body. Furthermore, because there is a flexible body, the first conducting pin can freely move upwards and downwards and has better flexibility. Therefore, the problem of the conducting pin being deformed and failing is avoided. At the same time, the second conducting pin flexibly contacts the first conducting pin and the two conducting pins are flake-shaped to make the two conducting pins always be connected together. Thereby, the electrical connector is always electrically connected with the electronic element well.

Another particular aspect of the present invention is to provide an electrical connector that is used for connecting two electronic elements. The electrical connector includes an insulating body and conducting pins. There are a plurality of pin-receiving holes on the insulating body. Each of the conducting pins has a first conducting pin and a second conducting pin that moves relatively, and a flexible body located between the first conducting pin and the second conducting pin. At least one conducting pin flexibly contacts and is connected with the corresponding electronic element. The two conducting pins contact each other to conduct the two electronic elements. The two conducting pins contact each other via their structure.

There are two conducting pins in each of the pin-receiving holes of the electrical connector, and a flexible body is located between the two conducting pins. When an external force is exerted on the electrical connector, the two conducting pins can move upwards and downwards in the insulating body. Furthermore, because there is a flexible body, the two conducting pins can freely move along the upward and downward direction and have better flexibility so as to make the two conducting pins always be connected together. Thereby, the electrical connector is always electrically connected with the electronic element well.

A further particular aspect of the present invention is to provide an electrical connector that is used for connecting two electronic elements. The electrical connector includes an insulating body and conducting pins. There are a plurality of pin-receiving holes on the insulating body. Each of the conducting pins has a first conducting pin and a second conducting pin that moves relatively, and a flexible body located between the first conducting pin and the second conducting pin. At least one conducting pin flexibly contacts and is connected with the corresponding electronic element. The two conducting pins contact each other to conduct the two electronic elements. The material of the first conducting pin is different from that of the second conducting pin.

There are two conducting pins in each of the pin-receiving holes of the electrical connector, and a flexible body is located between the two conducting pins. The flexibility of the conducting pins is provided by the flexible body to lower the mechanical specification of the conducting pins. Because the materials for the two conducting pins are different, the mechanical performance and the conducting performance of the conducting pins can be coordinated. For example, one of the conducting pins uses a material having a high conducting rate, and the other conducting pin uses a material having a good mechanical performance.

A further particular aspect of the present invention is to provide an electrical connector that is used for connecting two electronic elements. The electrical connector includes an insulating body and conducting pins. There are a plurality of pin-receiving holes on the insulating body. Each of the conducting pins has a first conducting pin and a second conducting pin that moves relatively, and a flexible body located between the first conducting pin and the second conducting pin. At least one conducting pin flexibly contacts and is connected with the corresponding electronic element. The two conducting pins contact each other to conduct the two electronic elements. On the wall of the pin-receiving holes, there is a position-limiting structure for preventing the flexible body from being deformed.

The position-limiting structure located on the wall of the pin-receiving holes prevents the flexible body from being deformed. Therefore, the deformation of the flexible body caused by an external force to contact the conducting pins so as to make the conducting pins oscillate is avoided.

A further particular aspect of the present invention is to provide an electrical connector that is used for connecting two electronic elements. The electrical connector includes an insulating body and conducting pins. There are a plurality of pin-receiving holes on the insulating body. Each of the conducting pins has a first conducting pin and a second conducting pin that moves relatively, and a flexible body located between the first conducting pin and the second conducting pin. At least one conducting pin flexibly contacts and is connected with a corresponding electronic element. The two conducting pins contact each other to conduct the two electronic elements. On at least one conducting pin, there is a protective structure for protecting the flexible body.

By using the protective structure, lateral bending of the flexible body is avoided.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
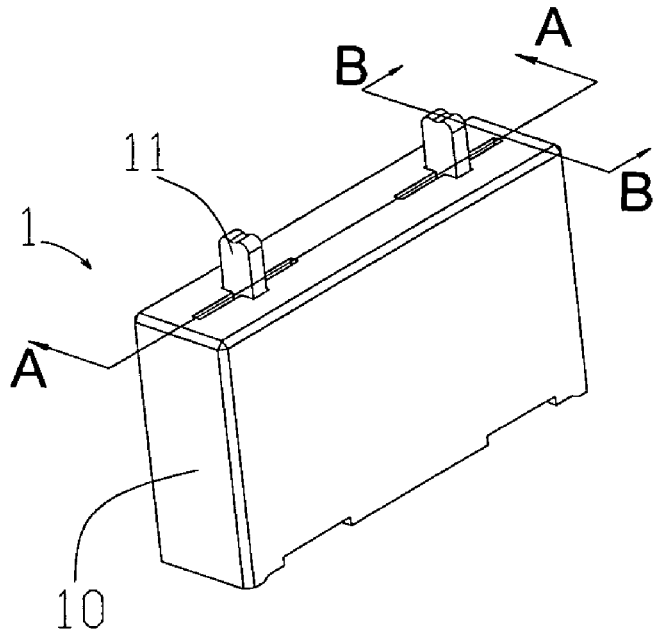
FIG. 1 is an assembly perspective view of the electrical connector of the present invention.
Figure 2:
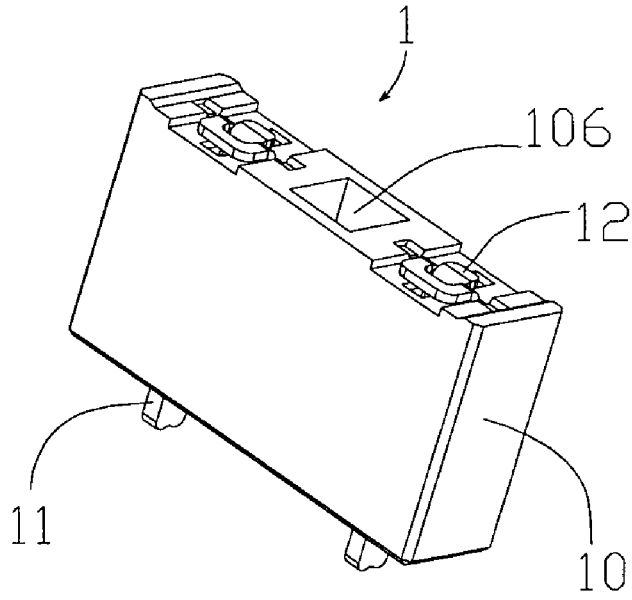
FIG. 2 is another assembly perspective view of the electrical connector of FIG. 1.
Figure 3:
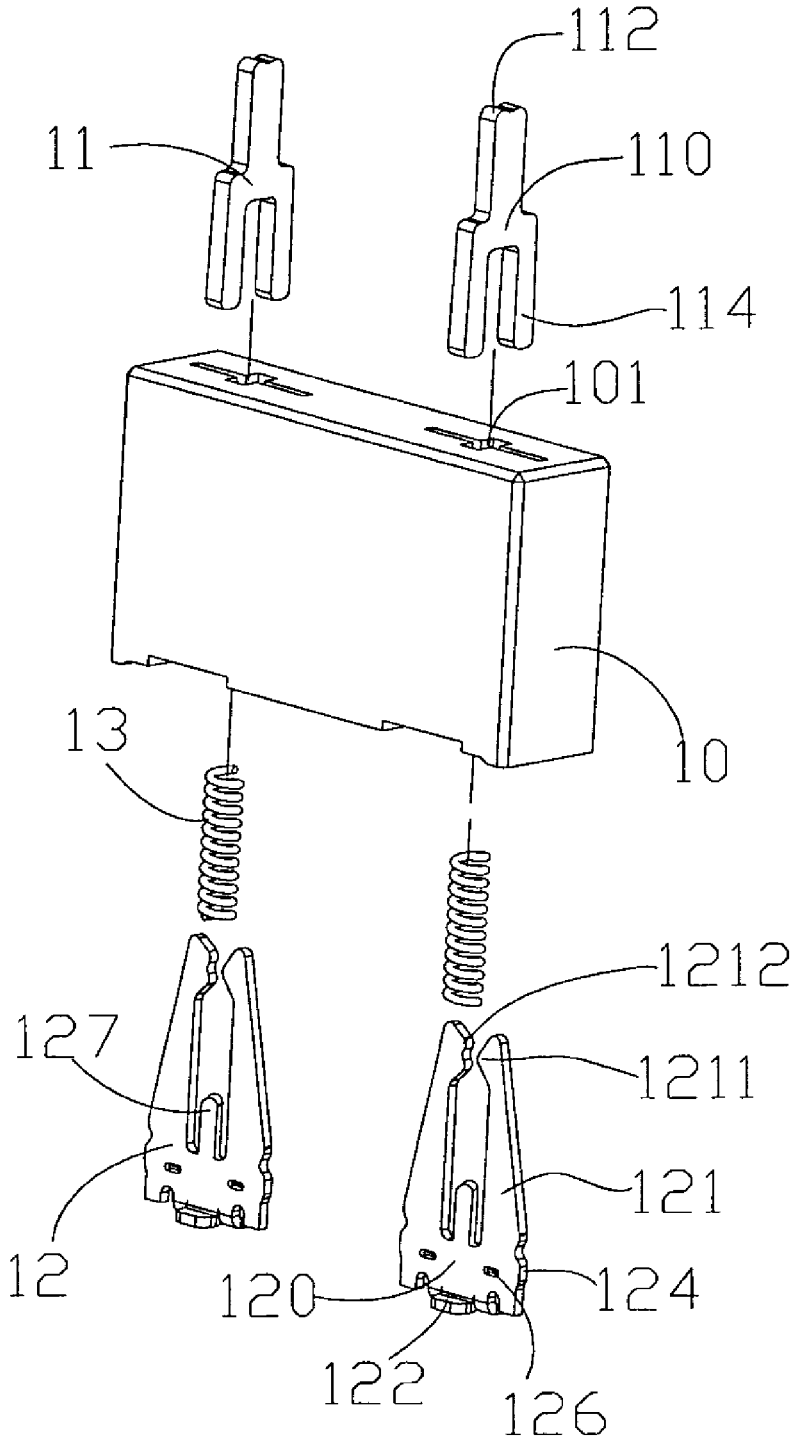
FIG. 3 is an exploded perspective view of the electrical connector of FIG. 1.
Figure 4:
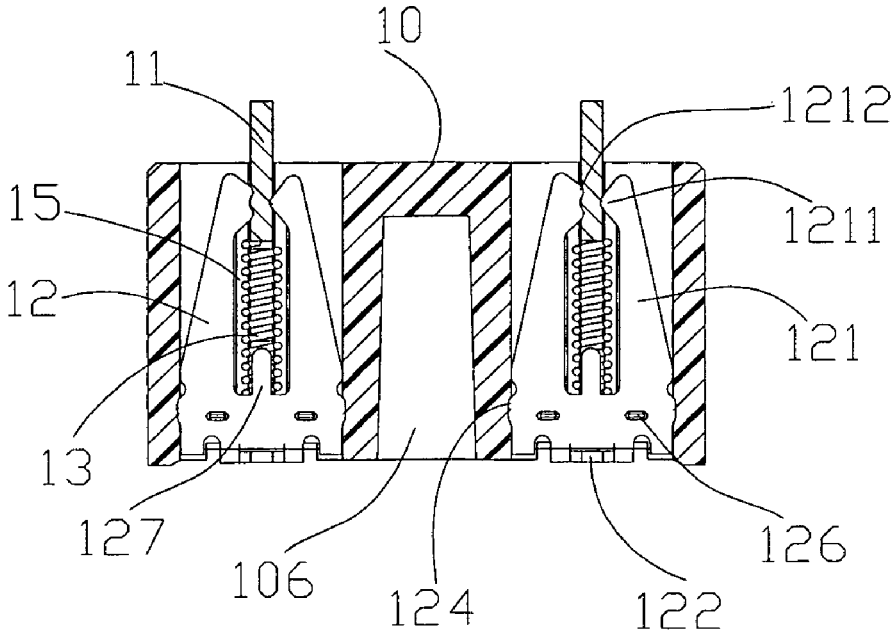
FIG. 4 is a cross-sectional view of the electrical connector of FIG. 1 in A-A cross-section.
Figure 5:
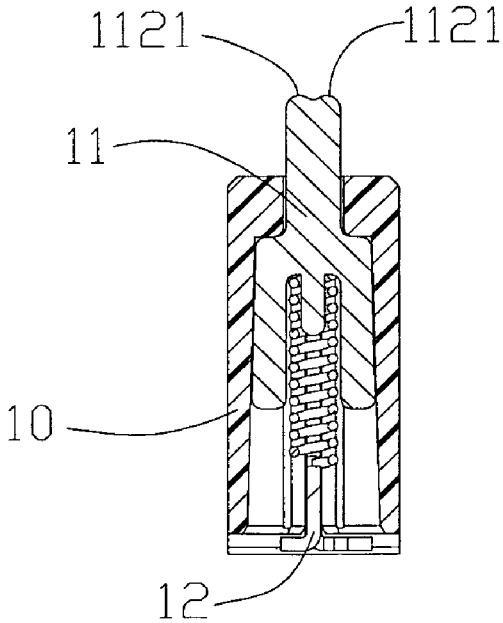
FIG. 5 is a cross-sectional view of the electrical connector of FIG. 1 in B-B cross-section.
Figure 6:
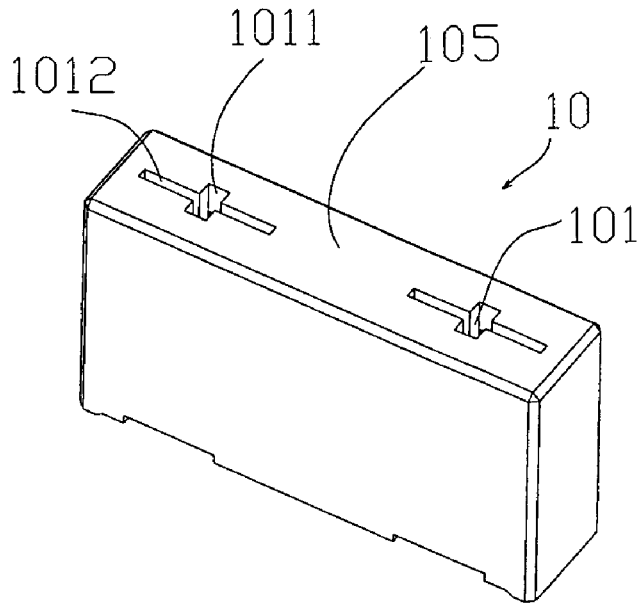
FIG. 6 is a perspective view of the insulating body of the electrical connector of FIG. 1.
Figure 7:
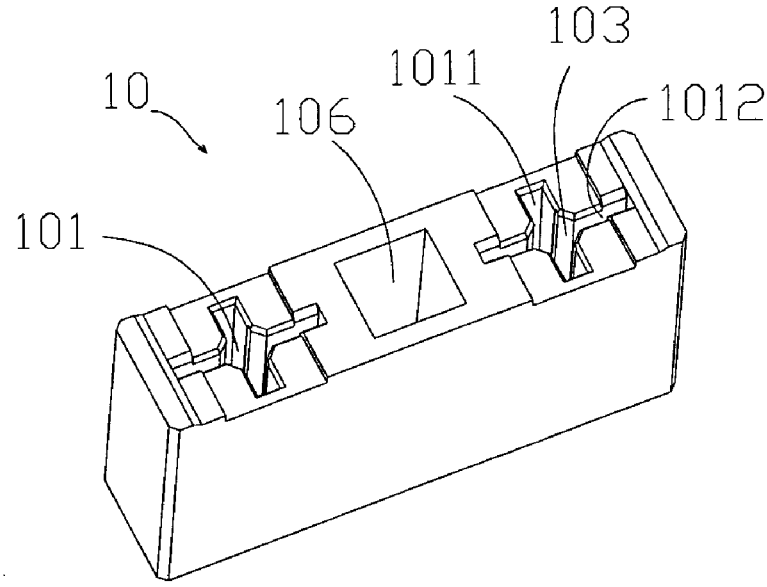
FIG. 7 is another perspective view of the insulating body of FIG. 6.
Figure 8:
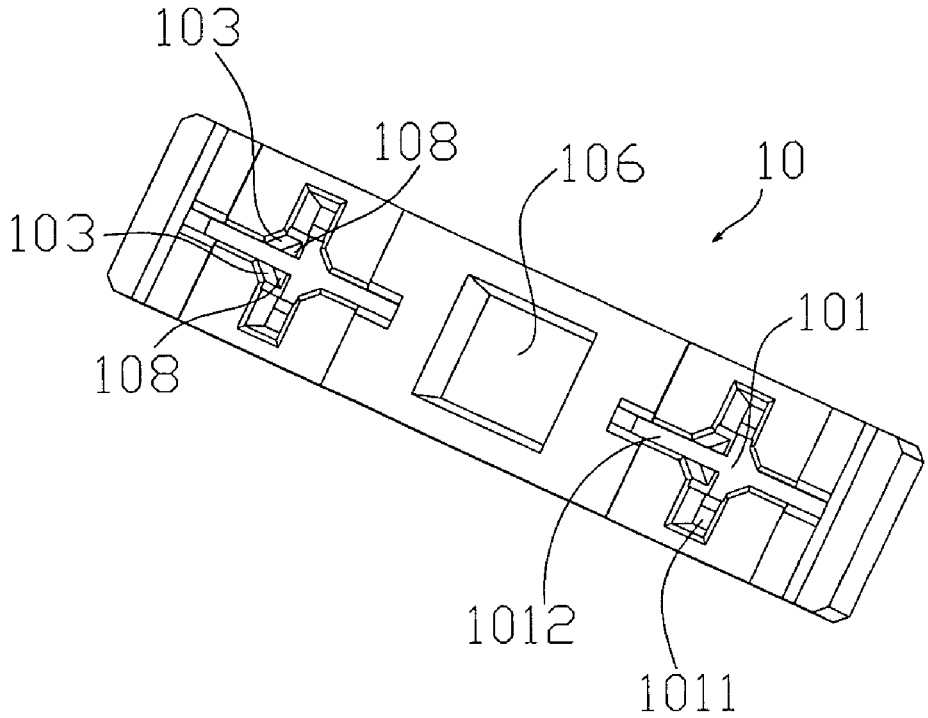
FIG. 8 is a further perspective view of the insulating body of FIG. 6.

Reference is made to FIGS. 1~8. The electrical connector 1 is used for connecting two electronic elements (not shown in the figure). The electrical connector 1 includes an insulating body 10, a first conducting pin 11, a second conducting pin 12, and a flexible body located between the first conducting pin 11 and the second conducting pin 12. In this embodiment, the flexible body is a spring 13. Alternatively, the flexible body can be made from other materials that have the same characteristics, such as a macromolecule flexible block (not shown in the figure). The two conducting pins 11, 12 are flake-shaped.

On the insulating body 10, there are two pin-receiving holes 101 that pass through the upper and lower surfaces of the insulating body 10. The pin-receiving hole 101 has a cross shape. The pin-receiving hole 101 includes a first pin-receiving hole 1011, and a second pin-receiving hole 1012 being vertical to the first pin-receiving hole 1011. On the wall crossed by the first pin-receiving hole 1011 and the second pin-receiving hole 1012, there is a position-limiting structure 103. In this embodiment, the position-limiting structure 103 is an inverse angle located at the crossing area of the first pin-receiving hole 1011 and the second pin-receiving hole 1012. The position-limiting structure is a plane on the hole wall (when the crossing area of the first pin-receiving hole 1011 and the second pin-receiving hole 1012 is an inverse circular angle, the position-limiting structure has a curved surface, not shown in the figure). Alternatively, if there is not an inverse angle located at the crossing area of the first pin-receiving hole 1011 and the second pin-receiving hole 1012, the position-limiting structure 103 has a rhombus angle formed at the crossing area of the first pin-receiving hole 1011 and the second pin-receiving hole 1012. Its shape can be a cross (not shown in the figure). At one end of the position-limiting structure 103, there is a positioning block 108 for positioning the spring. On the upper surface of the insulating body 10, there is a plate surface 105 located between the two pin-receiving holes 101. In the process of installing the electrical connector to the electronic element, the vacuum absorber (not shown in the figure) attached onto the plate surface 105 to increase the installing speed. On the lower surface of the insulating body 10, there is a material-taking hole 106 located between the two pin-receiving holes 101.

The first conducting pin 11 is made of red bronze. The contained copper is over 95%. The electric conductivity is higher than 70% IACS. The first conducting pin 11 includes a first body 110 and a first conducting part 112 extending upward from the middle of upper end of the first body 110. There are two concave contacting points 1211 at the middle of the first conducting part 112. There are two side arms 114 extending downward from the two sides of the lower end of the first body 110.

The second conducting pin 12 is an alloy copper (such as a bronze, or a phosphorous copper). The second conducting pin 12 includes a second body 120. There are two flexible arms 121 extending upward from two sides of the second body 120. In the inner side of the end of the two flexible arms 121, there are contacting points 1211, 1212. The contacting points 1211, 1212 located on the two flexible arms are staggered and disposed in the vertical direction. There are second conducting parts 122 extending vertically from two sides of the bottom end of the second body 120. The second conducting parts 122 respectively extend forward the two sides of the second body 120 so as to increase the contacting area for contacting the electronic element. If the second conducting part 122 is soldered on the electronic element, there is a soldering material (not shown in the figure) on the second conducting part 122 to make the soldered second conducting pin 12 be exerted by a uniform force. There are holding parts 124 located on the two sides of the second body 120. When the second conducting pin 12 is installed in the pin-receiving hole 101, the holding parts 124 interfere with the hole wall of the second pin-receiving hole 1012 so as to make the second conducting pin 12 be held in the insulating body 10 firmly. On the second body 120, there is a convex point 126. The convex point 126 is also used for holding the second conducting pin 12 in the insulating body 10 firmly. There is a protective structure 127 on the second body 120. The protective structure 127 passes through the convex area at the middle of the flexible body to prevent the flexible body from being bent laterally. The protective structure 127 has a vertical surface.

When the first conducting pin 11, the second conducting pin 12, and the spring 13 are assembled in the pin-receiving holes 101 of the insulating body 10, the second conducting pin 12 is installed in the second pin-receiving hole 1012, the first conducting pin 11 is installed in the first pin-receiving hole 1011, and the first conducting pin 11 and the second conducting pin 12 are vertically staggered in the pin-receiving hole 101. The two flexible arms 121 of the second conducting pin 12, the two side arms 114 of the first conducting pin 11, the first body 110, and the second body 120 form a receiving space 15. The spring 13 is received in the receiving space 15. When a force is exerted, the upper end of the spring 13 leans against the lower end surface of the first body 110, and the lower end of the spring 13 leans against the upper end surface of the second body 120. If the spring 13 oscillates horizontally, the spring 13 leans against the position-limiting structure 103 so as to prevent the spring from being deformed by a force by contacting the conducting pin. Therefore, the oscillation that occurs on the conducting pin and deforms the conducting pin, as occurred in the prior art, is avoided. The contacting points 1211, 1212 located on the two flexible arms 121 of the second conducting pin 12 respectively contact and press two side surfaces of the first body 110 of the first conducting pin 11. Because the contacting points 1211, 1212 located on the two flexible arms 121 are staggered in vertical directions, the two flexible arms 121 are firmly held on the first body 110 of the first conducting pin 11 to make the two conducting pins 11, 12 conduct continuously. The second conducting part 122 of the second conducting pin 12 is connected with an external electronic element, such as a circuit board (not shown in the figure). The first conducting part 112 of the first conducting pin 11 is compressed and contacts another external electronic element (not shown in the figure). When another electronic element is compressed to the first conducting part 112, the first conducting pin 11 moves upwards and downwards in the insulating body 10 due to the external force. Because there is a spring, a reacting force is exerted on the first conducting pin 11 whose direction is opposite to the compressing force after the first conducting pin 11 is compressed. The reacting force is exerted on another electronic element that is connected with the first conducting pin 11. Therefore, the first conducting pin 11 provides a greater forward force that makes the first conducting pin 11 electrically connected with the other electronic element well.

Figure 9:
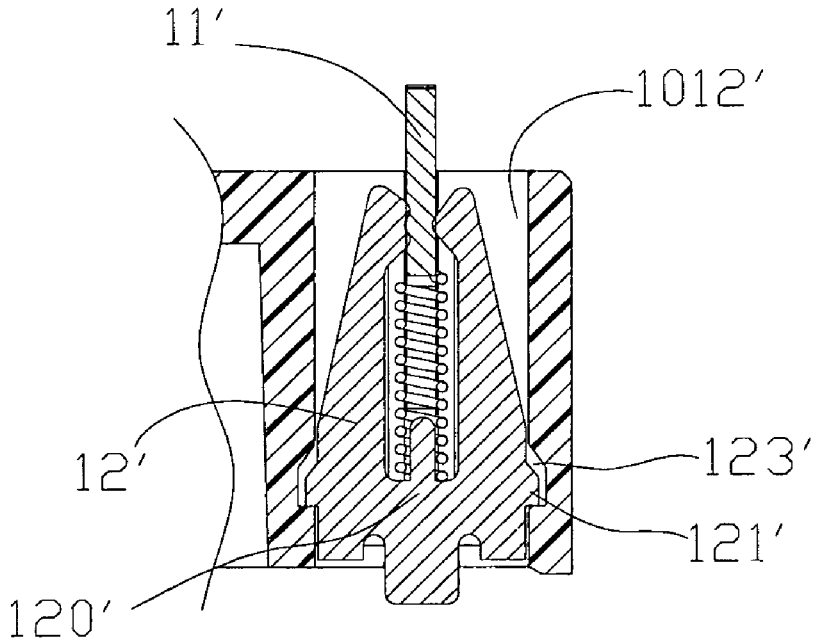
FIG. 9 is a schematic diagram of the electrical connector of another embodiment of the present invention.

Reference is made to FIG. 9, which shows a schematic diagram of the electrical connector of another embodiment of the present invention. The difference in this embodiment is that there are sliding blocks 121' located on two sides of the second body 120' of the second conducting pin 12'. On the wall of the second pin-receiving hole 1012' that corresponds to the sliding block 121, there is a sliding slot 123'. When the second conducting pin 12' is compressed, the sliding block 121' moves upwards and downwards along the sliding slot. At the same time, when the first conducting pin 11' has a force exerted upon it, the first conducting pin 11' can also move upwards and downwards. Therefore, when an external force is exerted, the first conducting pin 11' and the second conducting pin 12' can move upwards and downwards in the insulating body.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An electrical connector, used for connecting two electronic elements, comprising:

an insulating body having a plurality of pin-receiving passages formed therethrough;

a flake-shaped first conducting pin having a first body and a first conducting part extending upwardly from the first body;

a flake-shaped second conducting pin having a second body, said second body extending upward to form a pair of flexible arms, each of said flexible arms having a pair of convexly contoured contacting sections being located at respective ends of said flexible arms; and a flexible body;

wherein said first conducting pin is received in a first pin receiving passages of said insulating body and said second conducting pin is received in a second receiving passages of said insulating body, said first pin receiving passage extending transverse said second pen receiving passage on said insulating body, said flexible body being located between the first conducting pin and the second conducting pin for flexibly contacting the first conducting pin to the second conducting pin, wherein when an external electronic element contacts at least one of the first conducting pin or the second conducting pin the convexly contoured contacting sections formed on the flexible arms of the second conducting pin contacts the first body of the first conducting pin.

2. The electrical connector as claimed in claim 1, wherein the first conducting pin and the second conducting pin are vertically staggered in the respective first and second pin-receiving passages.

3. The electrical connector as claimed in claim 1, wherein the first body extends downward to form a sliding side arm.

4. The electrical connector as claimed in claim 1, wherein the contacting sections are staggered and disposed in a vertical direction.

5. The electrical connector as claimed in claim 1, wherein the second body of the second conducting pin further includes a second conducting part extending vertically from a lower portion thereof.

6. The electrical connector as claimed in claim 1, wherein there is a plate surface on the insulating body, and the plate surface is located between the pin-receiving passages.

7. An electrical connector, used for connecting two electronic elements, comprising:

an insulating body having a plurality of pin-receiving passages being formed therethrough;

a first conducting pin being made from a first material;

a second conducting pin being made of a second material; and a flexible body;

wherein said first conducting pin is received in a first pin receiving passage of said insulating body and said second conducting pin is received in a second receiving passage of said insulating body, said first pin receiving passage extending transverse said second pin receiving passage on said insulating body, said flexible body being located between the first conducting pin and the second conducting pin for flexibly contacting the first conducting pin to the second conducting pin;

wherein when an external electronic element contacts at least one of the first conducting pin or the second conducting pin, the first conducting pin and the second conducting pin contact each other.

8. The electrical connector as claimed in claim 7, wherein the material of the first conducting pin is a high electric conductivity material.

9. The electrical connector as claimed in claim 7, wherein the electric conductivity of the first conducting pin is over 70% IACS.

10. The electrical connector as claimed in claim 7, wherein the first conducting pin is made of red bronze.

11. The electrical connector as claimed in claim 7, wherein the material of the second conducting pin is a flexible material.

12. The electrical connector as claimed in claim 7, wherein the second conducting pin is a copper alloy.

13. The electrical connector as claimed in claim 7, wherein the first conducting pin and the second conducting pin are vertically staggered in the pin-receiving passage.

14. The electrical connector as claimed in claim 7, wherein the second conducting pin comprises a second body that extends upward to form a flexible arm that can hold the first conducting pin.

15. The electrical connector as claimed in claim 14, wherein at least one contacting section is convexly located at the flexible arms to contact the first conducting pin.

16. The electrical connector as claimed in claim 15, wherein the contacting sections are staggered and disposed in a vertical direction.

17. The electrical connector as claimed in claim 7, wherein the first conducting pin comprises a first body, the first body extends upward to form a first conducting part, and the first body extends downward to form two side arms.

18. The electrical connector as claimed in claim 7, wherein the second conducting pin comprises a second body, and the second body extends vertically to form a second conducting part.

19. An electrical connector, used for connecting two electronic elements, comprising:

an insulating body having a plurality of pin-receiving passages formed therethrough;

a first conducting pin having a first body and a first conducting part extending upwardly from the first body;

a second conducting pin having a second body, said second body extending upward to form a pair of flexible arms each of said flexible arms having a pair of convexly contoured contacting sections being located at respective ends of said flexible arms; and a flexible body;

wherein said first conducting pin is received in a first pin receiving passage of said insulating body and said second conducting pin is received in a second receiving passage of said insulating body, said first pin receiving passage extending transverse said second pin receiving passage on said insulating body, said flexible body being located between the first conducting pin and the second conducting pin;

wherein when an external electronic element contacts at least one of the first conducting pin or the second conducting pin, the convexly contoured contacting sections formed on the flexible arms of the second conducting pin contacts the first body of the first conducting pin, each other said insulating body further including a position-limiting structure for preventing the flexible body from being deformed on the wall of the first and second pin-receiving passages.

20. The electrical connector as claimed in claim 19, wherein the position-limiting structure is a plane located on the wall of each one of said pin-receiving passages.

21. The electrical connector as claimed in claim 19, wherein the position-limiting structure has a curved surface located on the wall of each one of said pin-receiving passages.

22. The electrical connector as claimed in claim 19, wherein the position-limiting structure is a rhombus angle located on the hole wall of each one of said pin-receiving passages.

23. The electrical connector as claimed in claim 19, wherein there is a positioning block located at end of the position-limiting structure that positions the flexible body.

24. The electrical connector as claimed in claim 19, wherein the flexible body is received in one of said pin-receiving passages and when a force is exerted upon the pin-receiving passage, the flexible body against the position-limiting structure.

25. The electrical connector as claimed in claim 19, wherein the first body extends downward to form a sliding side arm.

26. The electrical connector as claimed in claim 25, wherein the contacting sections are staggered and disposed in a vertical direction.

27. The electrical connector as claimed in claim 19, wherein a second conducting part vertically extends from the second body to at least one side from bottom of the second body.

28. An electrical connector, used for connecting two electronic elements, comprising:

an insulating body having a plurality of pin-receiving passages being formed therethrough;

a first conducting pin having a first body and a first conducting part extending upwardly from the first body;

a second conducting pin having a second body, said second body extending upward to form a pair of flexible arms, each of said flexible arms having a pair of convexly contoured contacting sections being located at respective ends of said flexible arms; and a flexible body;

wherein said first conducting pin is received in a first pin receiving passage of said insulating body and said second conducting pin is received in a second receiving passage of said insulating body, said first pin receiving passage extending transverse said second pin receiving passage on said insulating body, said flexible body being located between the first conducting pin and the second conducting pin;

wherein when an external electronic element contacts at least one of the first conducting pin or the second conducting pin, the convexly contoured contacting sections formed on the flexible arms of the second conducting pin contacts the first body of the first conducting pin, wherein at least one of said first conducting pin or said second conducting pin further including a protective structure for protecting the flexible body when said first conducting pin electrically contacts said second conducting pin.

29. The electrical connector as claimed in claim 28, wherein the protective structure is a convex part that passes through the middle of the spring for preventing the spring from being bent laterally.

30. The electrical connector as claimed in claim 28, wherein the protective structure comprises a vertical surface.

31. The electrical connector as claimed in claim 28, wherein the first body extends downward to form a sliding side arm.

32. The electrical connector as claimed in claim 28, wherein the contacting points are staggered and disposed in a vertical direction.

33. The electrical connector as claimed in claim 28, wherein a second conducting part extends from the second body.

34. The electrical connector as claimed in claim 33, wherein there is a soldering material on the second conducting part.

* * * * *